US008733455B2

(12) United States Patent
Shaikh et al.

(10) Patent No.: US 8,733,455 B2
(45) Date of Patent: May 27, 2014

(54) ROLLER STANDOFF ASSEMBLIES

(75) Inventors: Farhat A. Shaikh, Houston, TX (US); James C. Hunziker, New Caney, TX (US); Paul G. Junghans, Houston, TX (US); Ron Parsley, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 209 days.

(21) Appl. No.: 13/436,950

(22) Filed: Apr. 1, 2012

(65) Prior Publication Data

US 2012/0255744 A1 Oct. 11, 2012

Related U.S. Application Data

(60) Provisional application No. 61/472,416, filed on Apr. 6, 2011.

(51) Int. Cl.
*E21B 17/10* (2006.01)

(52) U.S. Cl.
USPC ..... 166/380; 166/241.6; 166/241.7; 175/325.5; 175/325.6

(58) Field of Classification Search
CPC ..... E21B 17/1057; E21B 17/1064
USPC ..... 166/380, 241.1–241.7; 175/325.1–326
See application file for complete search history.

(56) References Cited

U.S. PATENT DOCUMENTS

| | | | | | |
|---|---|---|---|---|---|
| 1,699,087 | A * | 1/1929 | Woodmansee et al. | .... | 166/241.3 |
| 1,715,547 | A * | 6/1929 | Hardesty | ..... | 175/325.3 |
| 1,831,999 | A * | 11/1931 | Bull | ..... | 175/325.3 |
| 1,890,529 | A * | 12/1932 | Santiago | ..... | 175/325.3 |
| 1,913,365 | A * | 6/1933 | Bailey | ..... | 175/325.3 |
| 2,436,994 | A * | 3/1948 | Gillespie | ..... | 166/241.4 |
| 2,625,445 | A * | 1/1953 | Ring | ..... | 166/241.5 |
| 3,874,491 | A * | 4/1975 | Faure | ..... | 193/35 MD |
| 3,878,927 | A | 4/1975 | Murakami | ..... | 193/37 |
| 3,961,694 | A | 6/1976 | Murakami | ..... | 193/37 |
| 4,549,613 | A * | 10/1985 | Case | ..... | 175/325.2 |
| 5,069,297 | A * | 12/1991 | Krueger et al. | ..... | 175/65 |
| 5,167,279 | A | 12/1992 | Stafford | ..... | 166/171 |
| 5,339,910 | A | 8/1994 | Mueller | ..... | 175/61 |
| 5,404,984 | A * | 4/1995 | Hagman | ..... | 193/35 MD |
| 5,517,734 | A * | 5/1996 | Korpi | ..... | 24/453 |
| 5,522,467 | A * | 6/1996 | Stevens et al. | ..... | 175/73 |
| 5,649,603 | A | 7/1997 | Simpson et al. | ..... | 175/323 |
| 5,692,563 | A * | 12/1997 | Krueger et al. | ..... | 166/85.5 |
| 5,778,976 | A | 7/1998 | Murray | ..... | 166/241.6 |
| 6,209,667 | B1 * | 4/2001 | Murray et al. | ..... | 175/325.3 |
| 6,250,394 | B1 * | 6/2001 | Mashburn | ..... | 166/382 |
| 6,250,406 | B1 * | 6/2001 | Luke | ..... | 175/325.2 |
| 6,382,333 | B1 | 5/2002 | Murray | ..... | 175/325.3 |
| 6,494,274 | B1 | 12/2002 | Murray et al. | ..... | 175/325.3 |
| 6,585,043 | B1 | 7/2003 | Murray | ..... | 166/241.3 |
| 7,661,489 | B2 * | 2/2010 | Fyfe | ..... | 175/346 |
| 2002/0023782 | A1 * | 2/2002 | Appleton et al. | ..... | 175/325.3 |
| 2003/0132005 | A1 * | 7/2003 | Tulloch et al. | ..... | 166/380 |
| 2003/0159834 | A1 | 8/2003 | Kirk et al. | ..... | 166/378 |
| 2003/0170070 | A1 * | 9/2003 | Mills et al. | ..... | 403/154 |
| 2004/0188147 | A1 * | 9/2004 | Mitchell et al. | ..... | 175/325.3 |
| 2004/0208691 | A1 * | 10/2004 | Kienzler | ..... | 403/322.1 |
| 2005/0092527 | A1 * | 5/2005 | Le et al. | ..... | 175/325.6 |
| 2009/0003974 | A1 | 1/2009 | McNay | ..... | 414/22.51 |
| 2012/0031609 | A1 * | 2/2012 | Wheater et al. | ..... | 166/241.5 |
| 2012/0186818 | A1 * | 7/2012 | Wollmann | ..... | 166/301 |

* cited by examiner

*Primary Examiner* — Blake Michener
(74) *Attorney, Agent, or Firm* — Shawn Hunter

(57) ABSTRACT

Roller standoff assemblies and devices facilitate disposal of an interior tubular member within an exterior tubular member. Roller standoff devices include a roller cage and at least one roller supported by the roller cage to contact and roll upon the exterior tubular member.

19 Claims, 11 Drawing Sheets

ROLLER STANDOFF ASSEMBLIES

This application claims priority to U.S. provisional patent application Ser. No. 61/472,416 filed Apr. 6, 2011.

BACKGROUND OF THE INVENTION

1. Field of the Invention

The invention relates generally to roller devices that are used to aid in disposing an inner tubular member within an outer tubular member.

2. Description of the Related Art

During development of a wellbore for production, it is often necessary to run a smaller interior tubular member or string into a larger, exterior tubular member or string. For example, a production liner string might be run into a surrounding casing string. In another example, a logging tool might be run into a production tubing string on wireline. In such cases, one or more centralizers or other roller standoff devices might be attached to the interior tubular member or string to facilitate insertion of the interior tubing members or strings.

Roller standoff devices are described in U.S. Pat. Nos. 6,382,333 and 6,585,043 issued to Murray; U.S. Pat. Nos. 3,878,927 and 3,961,694 issued to Murakami, U.S. Patent Publication No. 2003/0159834 by Kirk et al., and U.S. Patent Publication No. 2009/0003974 by McNay.

SUMMARY OF THE INVENTION

The present invention provides improved roller standoff assemblies and devices which can be readily attached and removed from an interior tubular member or string and used to facilitate disposal of the interior tubular member or string into a larger, exterior tubular member or string. In particular embodiments, roller standoff devices include a roller cage which carries a number of individual rollers that are designed to contact the exterior tubular member/string and roll along it. In embodiments, the rollers are provided with indentations on their contact surface which aids in the rollers gaining traction. In further embodiments, the indentations are oriented at an angle to the longitudinal axis of the roller they are formed in, thereby reducing any vibration that might be induced into the exterior tubular member/string during operation.

In certain embodiments, the roller cage of the roller standoff device is formed of cage halves that are pivotably secured at a hinge and moveable between an open configuration and a closed configuration. In described embodiments, the roller cage is secured in the closed position by a latch assembly that is preferably spring-loaded and capable of being secured and released rapidly and easily. When secured in the closed position, the roller cage preferably rotates readily about the axis of the interior tubular.

In particular embodiments, a roller standoff assembly is provided with a clamshell adaptor that permits a roller standoff device to be secured onto a joint coupling between two interior tubular members which has a number of wrench flats. An exemplary clamshell adaptor is described which includes a pair of mating halves having interior radial surfaces which are complimentary in shape to that of the joint coupling. Each of the halves also presents a radially outer surface that is shaped to provide a track within which the roller cage can reside. The track permits the roller cage to rotate freely about the hex joint. In a further embodiment, an exemplary clamshell adaptor provides a pair of shoulders that retain the roller cage within the track.

Assemblies constructed in accordance with the present invention are of particular value in deviated bores wherein portions of the inner tubular member tend to frictionally engage the lower portion of the outer tubular member. Roller standoff assemblies in accordance with the present invention may attach to the exterior of a new or existing tubular product to improve deployment of the tubular product in an open hole wellbore, tubular, casing, pipe, etc., by reducing friction through the use of rollers and axial rotation of the standoff device.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

FIGS. 1-4 depict an exemplary roller standoff device 10 which is constructed in accordance with the present invention. In a current embodiment, the standoff device 10 includes an annular roller cage 12 which is made up of two, generally semi-circular cage halves 12*a*, 12*b*. The cage halves 12*a*, 12*b* are both pivotably secured to a hinge pin 14. As a result, the cage halves 12*a*, 12*b* of the roller cage 12 can be moved between an open configuration (FIG. 1) wherein the roller cage 12 can be placed around an interior tubular member and a closed configuration (FIG. 2) wherein the roller cage 12 forms a closed annular ring.

Figure 1:
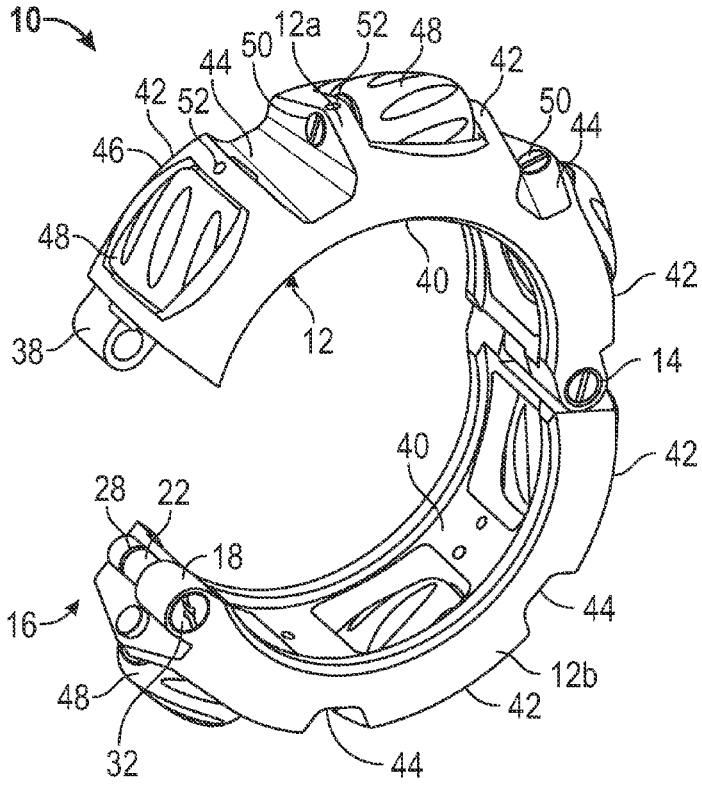
FIG. 1 is an external, isometric view of an exemplary roller standoff device constructed in accordance with the present invention and in an open configuration.
Figure 1A:
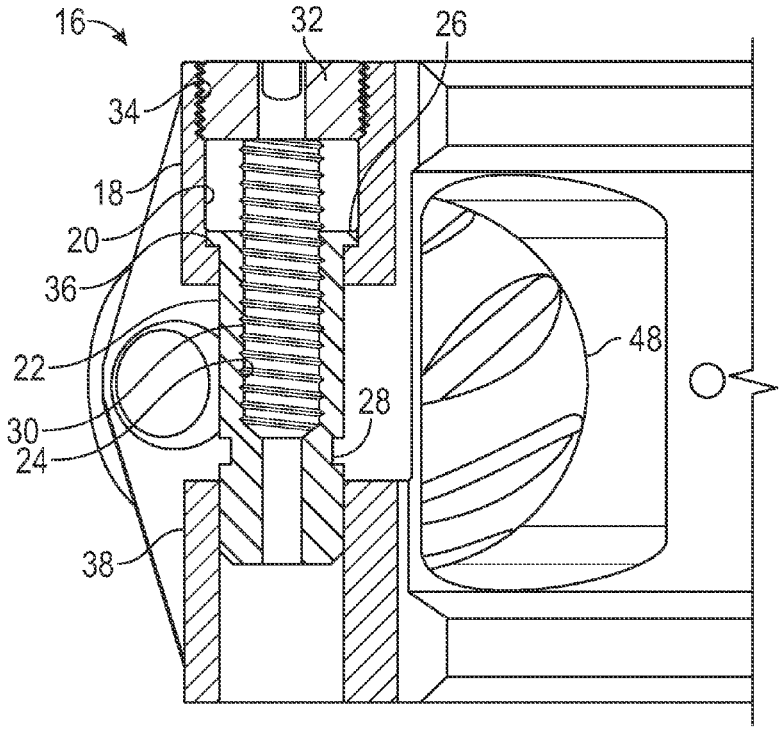
FIG. 1A is a detail, side, cross-sectional view of an exemplary latching assembly used in the roller standoff device of FIG. 1 and with the latching assembly in a latched condition.
Figure 3:
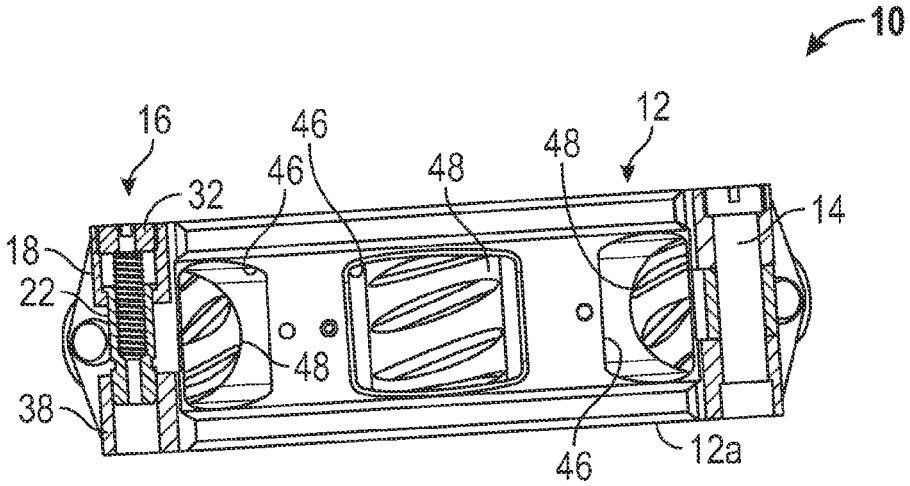
FIG. 3 is a cross-sectional view taken along lines 3-3 in FIG. 2.
Figure 4:
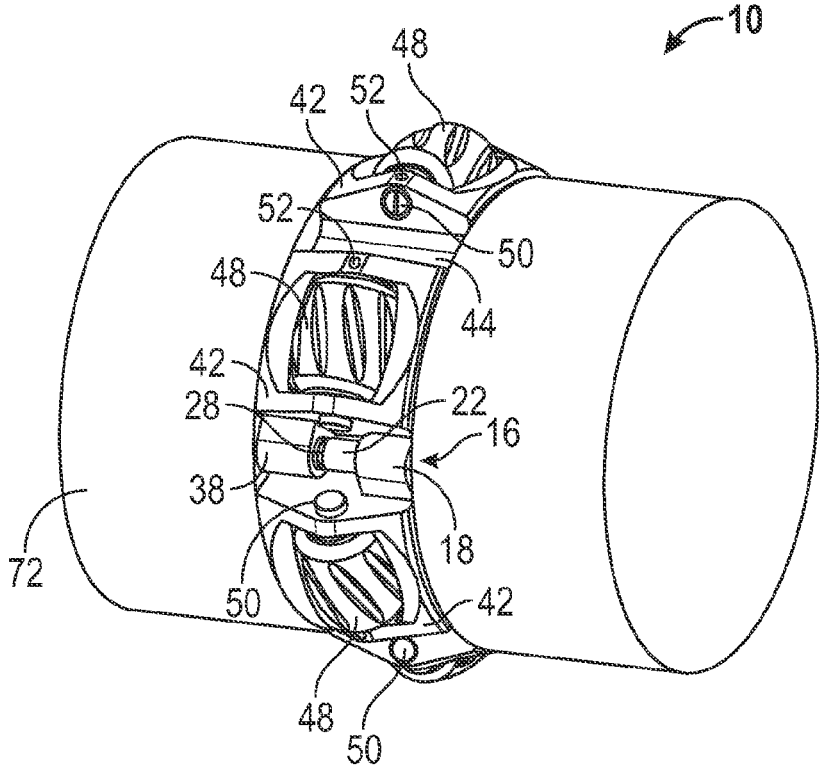
FIG. 4 is an external, isometric view of the roller standoff device shown in FIGS. 1-3, now disposed around a tubular member.

In a current embodiment, the roller cage 12 is provided with a spring-loaded latch assembly 16 which can be rapidly and easily secured and released. The latch assembly 16, which is shown in greater detail in FIGS. 1A and 1B, includes a pin-retaining housing 18 which encloses a chamber 20. As FIG. 1 illustrates, the pin-retaining housing 18 is formed on the cage half 12*b*. A generally cylindrical latching pin 22 is disposed partially within the chamber 20 and is moveable therewithin. The latching pin 22 defines an interior spring recess 24. The outer radial surface of the latching pin 22 presents an outwardly radially-projecting flange 26 which ensures that the latching pin 22 is retained within the chamber 20. The outer radial surface of the pin 22 also preferably includes an annular groove 28 that is shaped to be engageable by a tool or finger so as to move the pin 22 axially within the chamber 20. A compressible spring member 30 is located within the chamber 20 and the spring recess 24. A retaining nut 32 is secured within a threaded portion 34 of the chamber 20 and retains the spring member 30 within the recess 24. The spring member 30 biases the latching pin 22 downwardly until the flange 26 engages inwardly projecting lip 36 on the pin-retaining housing 18. In FIGS. 1A, 3 and 4, the latching assembly 16 is shown in a latched condition such that the latching pin 22 is disposed within a latching retainer 38 that is formed on the roller cage half 12*a*. This is the closed position for the roller cage 12. Thus, the latching pin 22 is moveable to be selectively latched within the latching retainer 38.

Figure 1B:
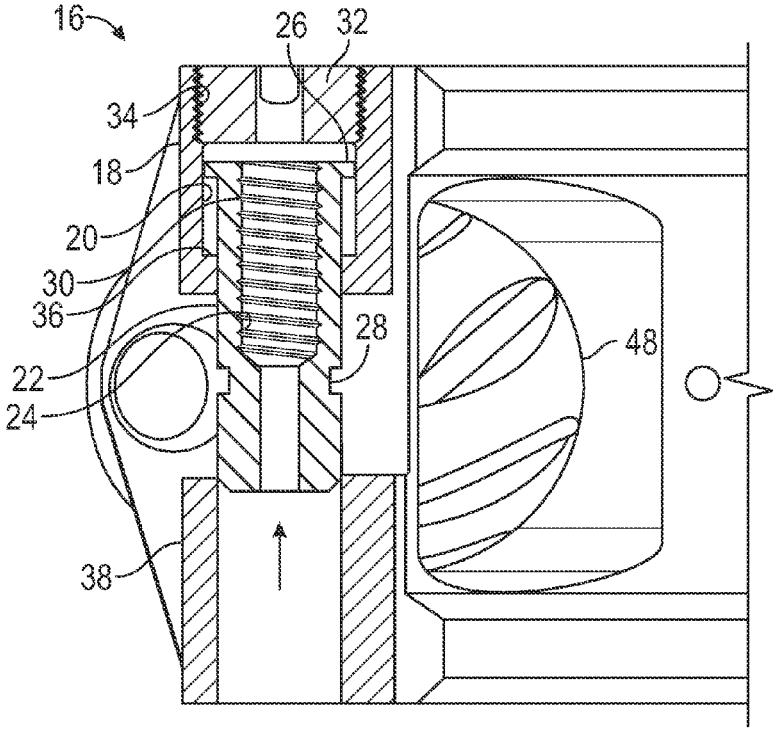
FIG. 1B is a detail, side, cross-sectional view of the latching assembly of FIG. 1A, now in an unlatched condition.
Figure 2:
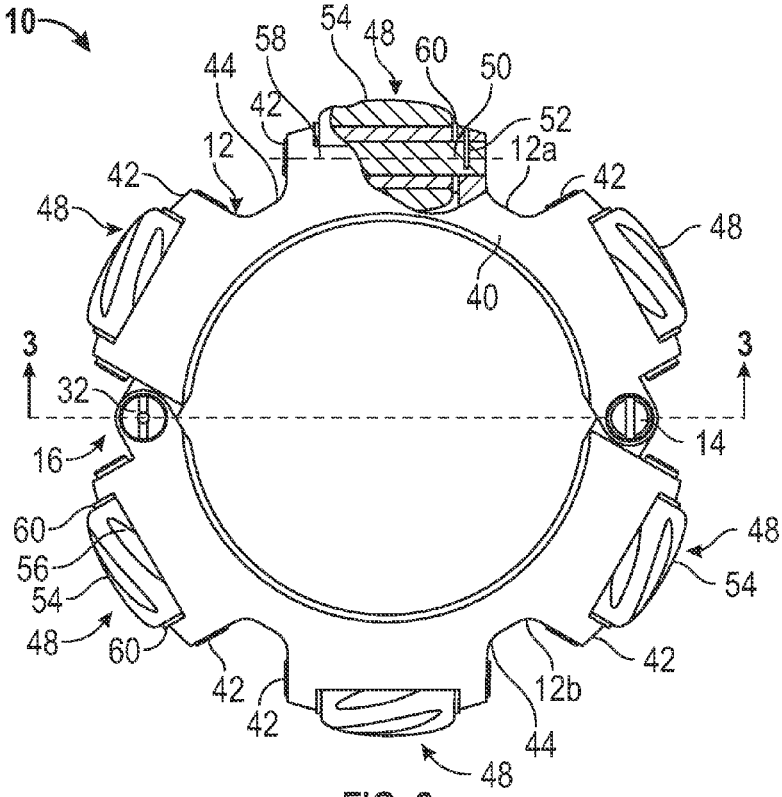
FIG. 2 is a top end view of the roller standoff device shown in FIG. 1, now in a closed configuration.

In order to move the roller cage 12 to its open position, an operator must engage the groove 28 and move the latching pin 22 to the position shown in FIG. 1B so as to compress the spring member 30. When this is done, the cage halves 12*a*, 12*b*, may be pivoted about the hinge pin 14 from their closed position to the open position shown in FIG. 1. In order to move the roller cage 12 from the open position to the closed position, an operator would similarly move the latching pin 22 to compress the spring 30. The cage halves 12*a*, 12*b* are pivoted to their closed position, and the pin 22 is released. The spring member 30 biases the latching pin 22 into seating engagement within the latching retainer 38. It will be understood by those of skill in the art that the construction and operation of the roller cage 12 and latch assembly 16 advantageously permits the roller standoff device 10 to be attached to and detached from an interior tubular member without loose hardware or the need for tools.

In the depicted embodiment, each of the cage halves 12*a*, 12*b* includes a central semicircular radially inner portion 40 and a plurality of roller lobes 42 which project radially outwardly from the radially inner portion 40. In the depicted embodiment, there are three lobes 42 provided on each cage half 12*a* and 12*b*. As a result, there are six total lobes 42. Gaps 44 separate each of the lobes 42 from each other and permit fluid flow past the roller standoff device 10 during operation. A roller recess 46 is formed within each roller lobe 42. The roller recesses 46 preferably are formed by openings which pass entirely through the body of the roller cage 12.

A generally cylindrical roller 48 is disposed within each roller recess 46 and is rotatable about a roller shaft 50 which passes through the lobe 42 and secures the roller 48 within the roller recess 46. The rollers 48 are supported by the roller cage 12 to contact and roll against an exterior tubular member. A retaining pin 52 is preferably disposed through the lobe 42 and roller shaft 50 to retain the roller shaft 50 in place. An alternative construction is depicted in the cross-sectional view of FIG. 13 which shows a plurality of ball bearings 53 disposed between the roller 48 and the shaft 50 in order to facilitate rotation of the roller 48 upon the shaft 50.

In one embodiment, the rollers 48 each present a radially outer rolling contact surface 54 having a plurality of indentations 56 which assists the rollers 48 in gaining traction upon a surrounding tubular member. As a result, the rollers 48 will more readily rotate and translate the interior tubular member or string within the outer tubular member or string. In the depicted embodiment, the indentations 56 are elongated and extend from a point proximate one axial end of the roller 48 to a point proximate the other axial end of the roller 48. In addition, each indentation 56 is oriented at an acute angle with respect to the axis 58 (see FIG. 2) of the roller shaft 50. The inventors have determined that this orientation of the indentation 56 reduces undesirable vibration of the surrounding outer tubular during operation and ensures that the roller 48 remains in constant contact with the outer tubular member throughout rotation of the roller 48. A currently preferred range of acute angles between the indentation 56 and the axis 58 is from about 30 degrees to about 50 degrees. An angle that is from about 40 degrees to about 45 degrees is particularly preferred.

In a further embodiment, thrust bearings 60 (see FIG. 2) are provided upon each roller shaft 50 at the axial ends of each roller 48. The thrust bearings 60 may comprise annular washers formed of a material that is substantially softer than the material used to form the rollers 48 and/or the roller cage 12. This permits the thrust bearings 60 to absorb torsional forces imposed by the rollers 48 during operation.

Figure 5:
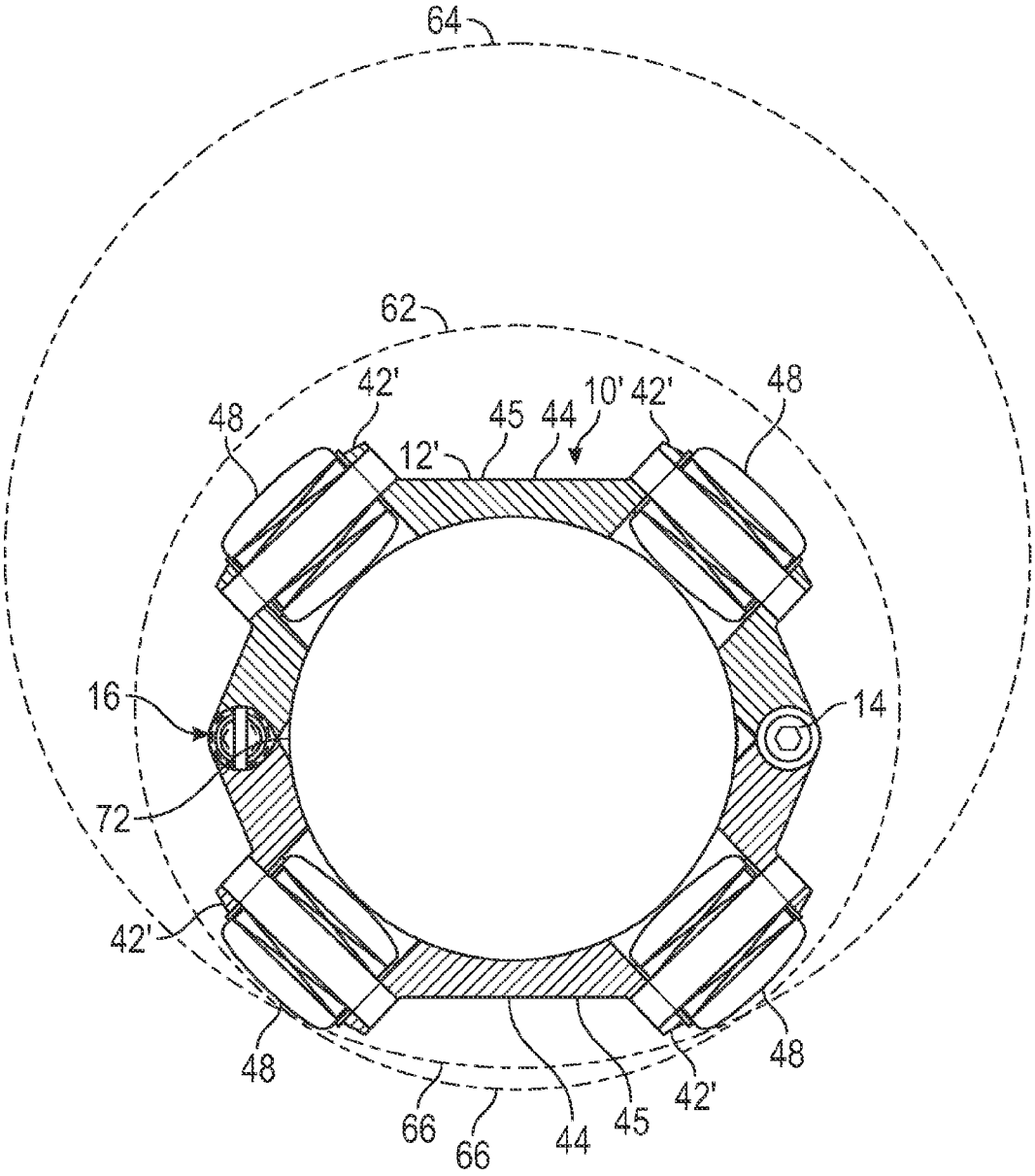
FIG. 5 is an end view of an alternative roller standoff device in accordance with the present invention shown in relation to exemplary surrounding tubular diameters.

FIG. 5 depicts an alternative embodiment for a roller standoff device 10' which is constructed similarly to the standoff device 10 in most respects. However, the roller standoff device 10' has four roller lobes 42' instead of six lobes. In FIG. 5, the roller standoff device 10' is depicted within the outlines of a 6-inch diameter deviated surrounding tubular 62 and an 8-inch diameter deviated wellbore 64. These tubulars 62, 64 are deviated in the sense that they depart from a vertical orientation and may be oriented substantially horizontally. Each deviated tubular 62, 64 provides a lower wellbore portion 66. It is noted that, in the instance of roller standoff device 10', at least two rollers 48 are in contact with the lower tubular portions 66, thereby permitting greater stability than devices which provide single point contact between the standoff device and the lower tubular portion 66. In addition, it is noted that the amount of clearance or standoff between the lower tubular portion 66 and the roller cage 12 is increased due to the use of the reduced-diameter gaps 44 between adjacent lobes 42, 42' or 42". In the instance of the roller standoff device 10' illustrated in FIG. 5, an increased amount of clearance for gaps 44 is provided by the use of planar surfaces 45. In the instance of roller standoff device 10" in FIG. 6, curved, reduced diameter outer surfaces 47 are employed.

Figure 6:
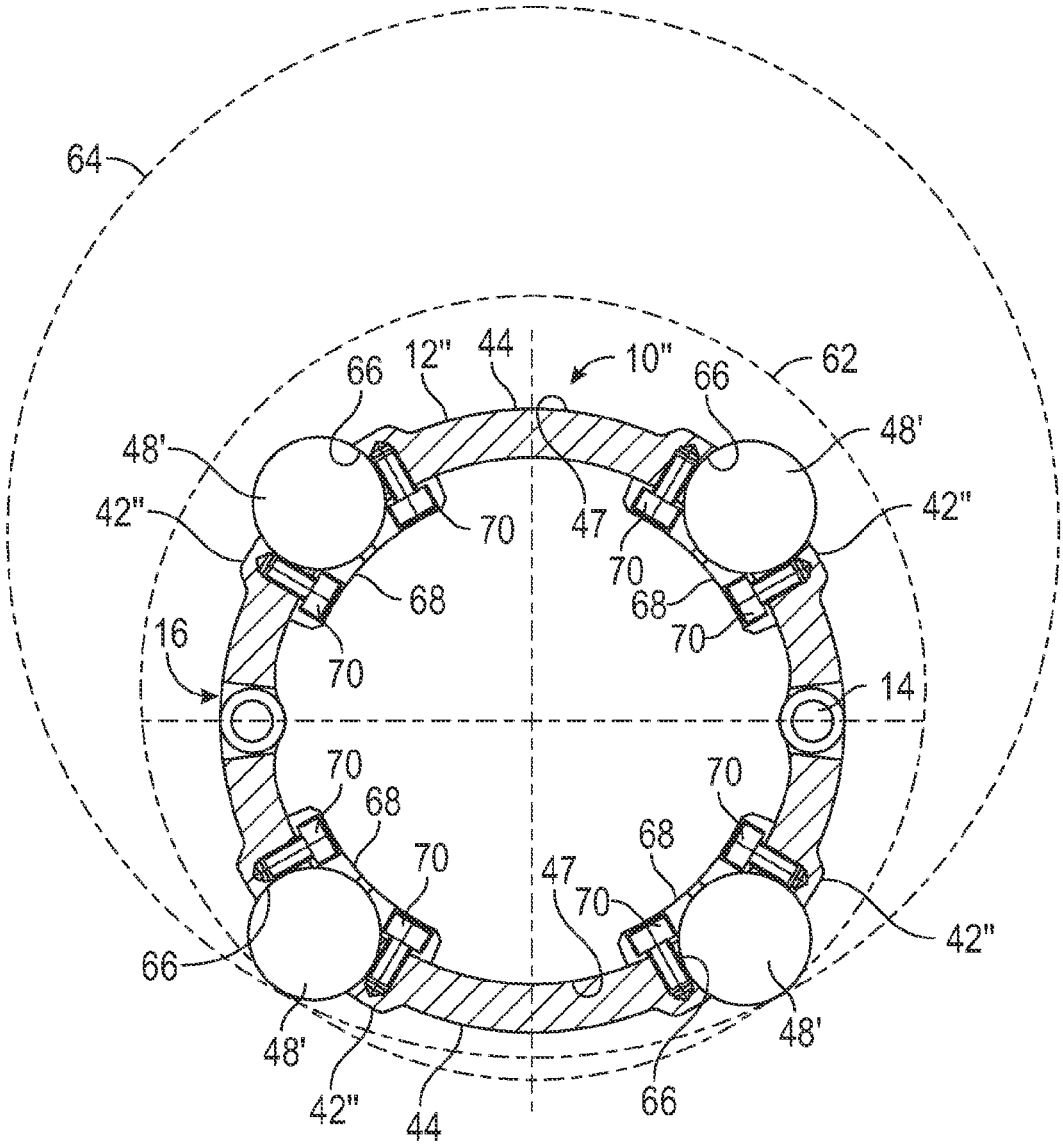
FIG. 6 is an end view of a further alternative roller standoff device in accordance with the present invention shown in relation to exemplary surrounding tubular diameters.
Figure 7:
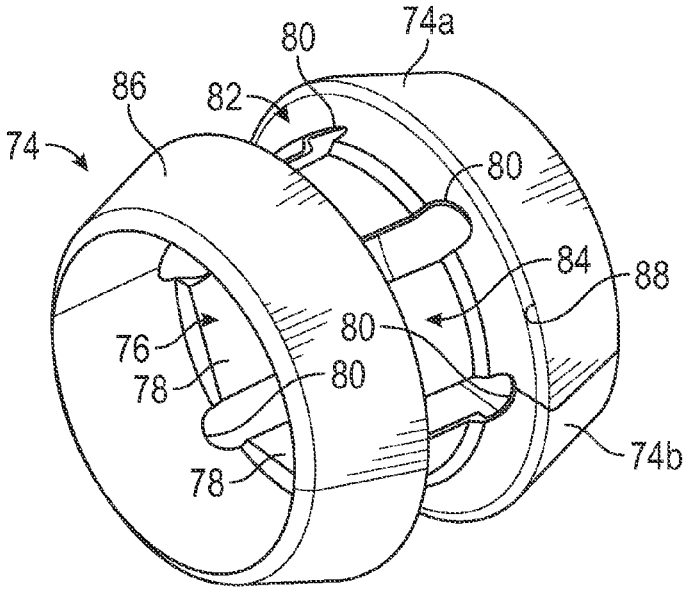
FIG. 7 is an external, isometric view of an exemplary clamshell adaptor that may be used with the roller standoff devices shown in FIGS. 1-6.
Figure 8:
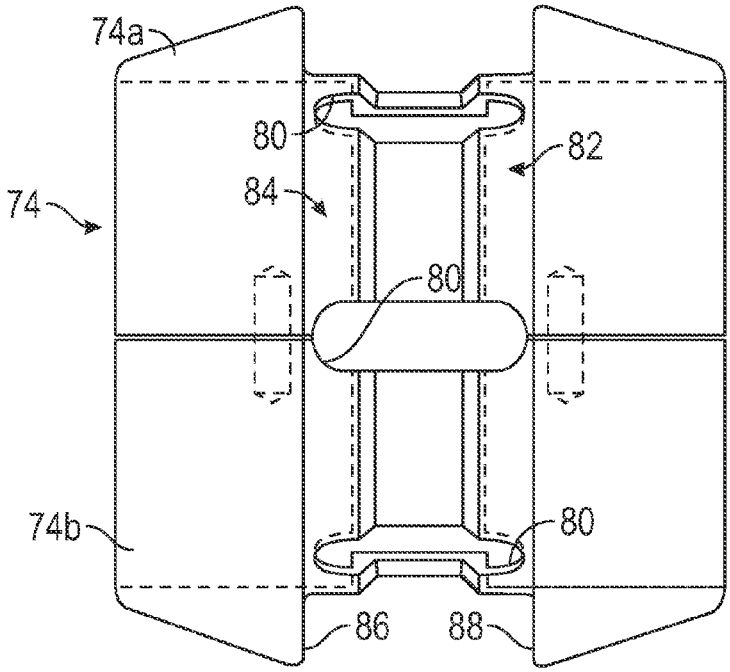
FIG. 8 is an external side view of the clamshell adaptor shown in FIG. 7.

FIG. 6 illustrates a further alternative roller standoff device 10" which is similar to the standoff device 10' in construction with the exception of the rollers that are used used. In roller standoff device 10", the rollers are spherical roller balls 48' which reside within ball recesses 66. Each roller ball 48' is retained within its respective recess 66 by a retaining plate 68 which is secured to the roller cage 12" by screws 70.

In operation, the roller standoff device 10, 10' or 10" is secured about an interior tubular member or string, such as the tubular member 72 depicted in FIGS. 4 and 5. In particular embodiments, the roller standoff device 10, 10' or 10" is affixed around a reduced diameter portion of a connection between two tubular members such that the roller cage 12, 12' of the standoff device can rotate about the axis of the interior tubular member or string. Then the interior tubular member 72 and roller standoff device 10, 10' or 10" is disposed into a surrounding exterior, larger diameter tubular member or string 62 or 64 (see, e.g., FIG. 5). The rollers 48, 48' of the roller standoff device 10, 10' or 10" will rollingly contact the interior surface of the exterior tubular member or string 62 and thereby facilitate the disposal of the interior tubular member or string into the exterior tubular member or string.

Figure 9:
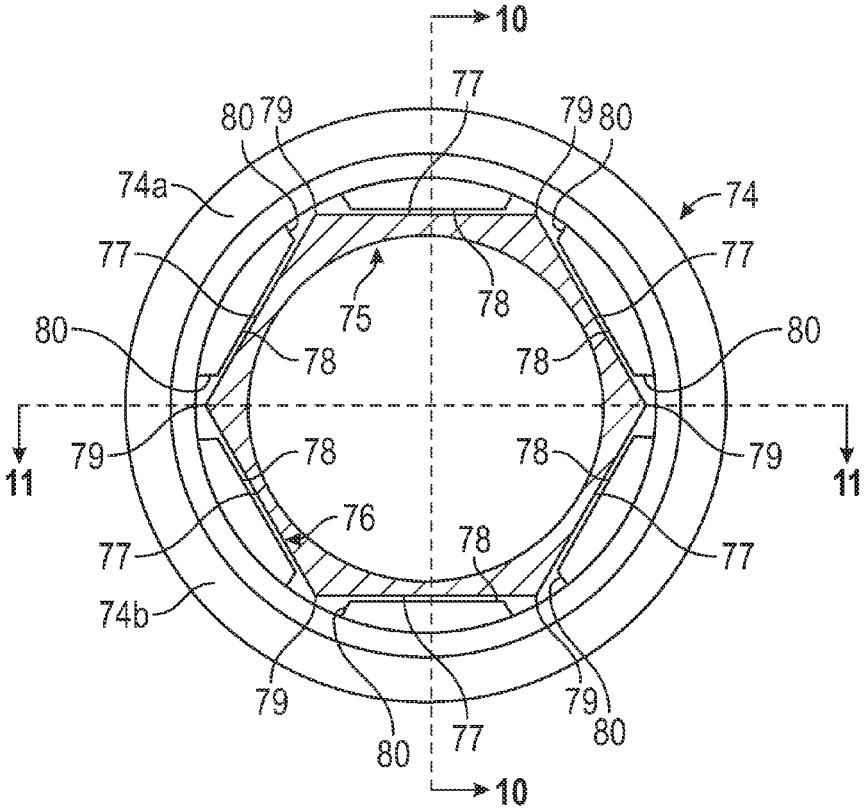
FIG. 9 is an axial end view of the clamshell adaptor shown in FIGS. 6 and 7.
Figure 10:
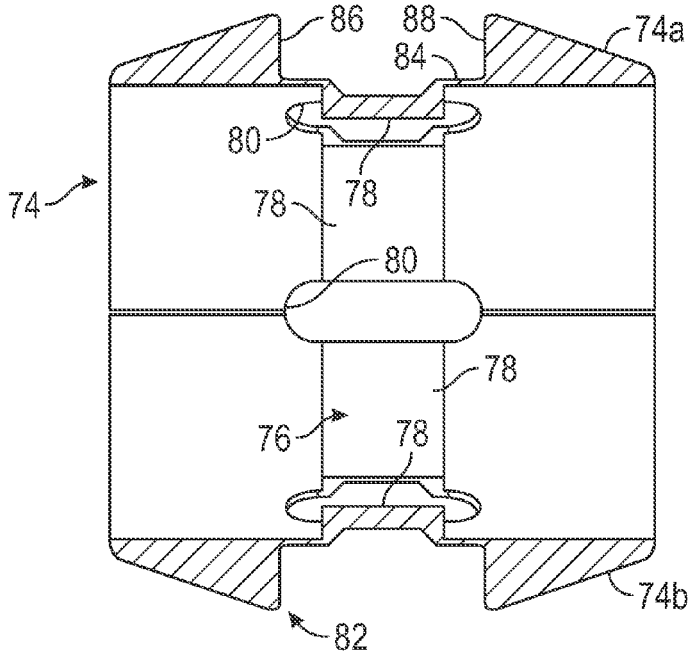
FIG. 10 is a cross-sectional view taken along lines 10-10 in FIG. 9.
Figure 11:
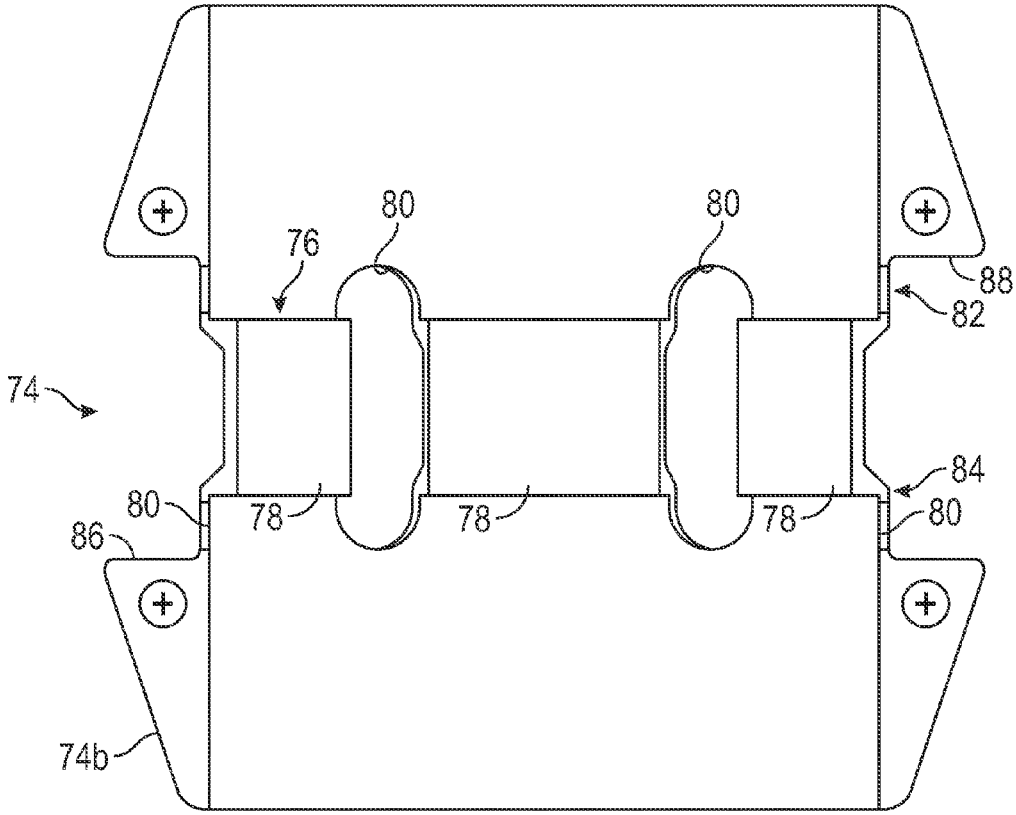
FIG. 11 is a cross-sectional view taken along lines 11-11 in FIG. 9.
Figure 12:
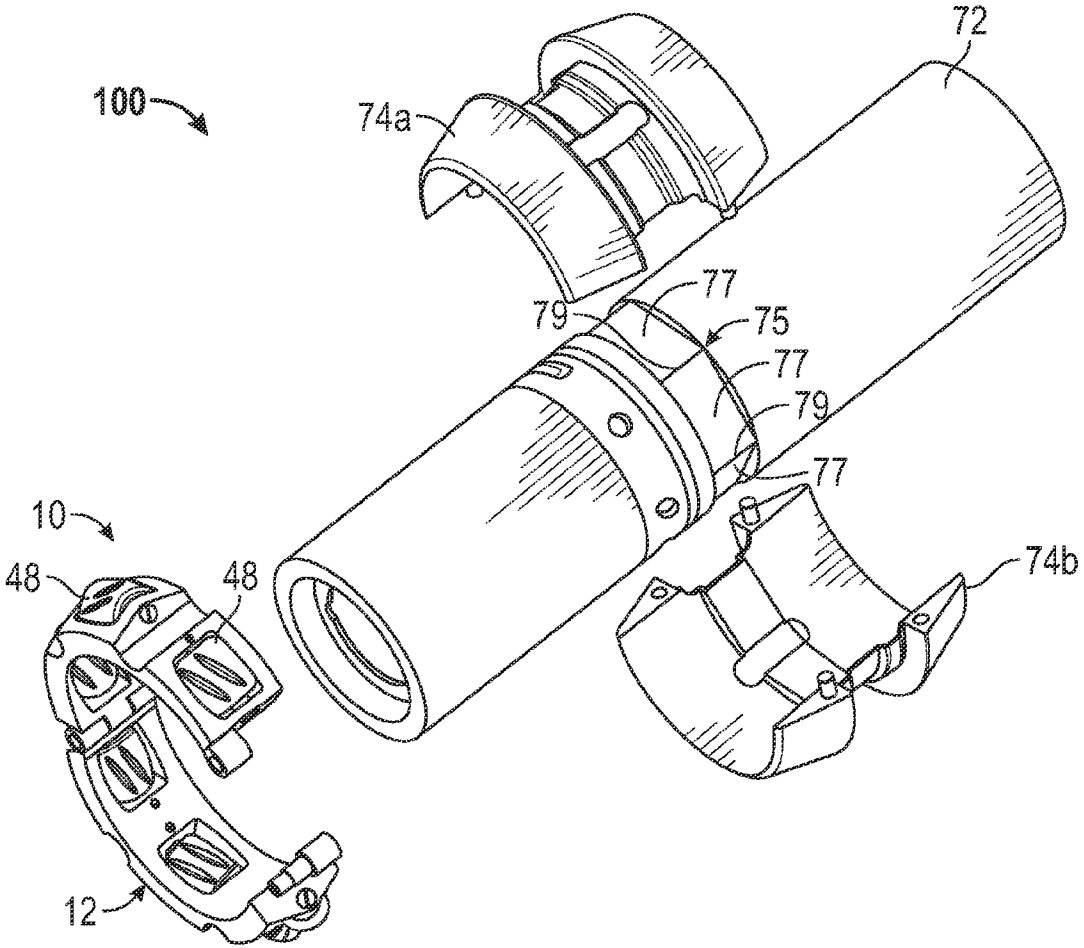
FIG. 12 is an exploded, isometric view of an exemplary roller standoff assembly having a roller standoff device and clamshell adaptor in accordance with the present invention.
Figure 13:
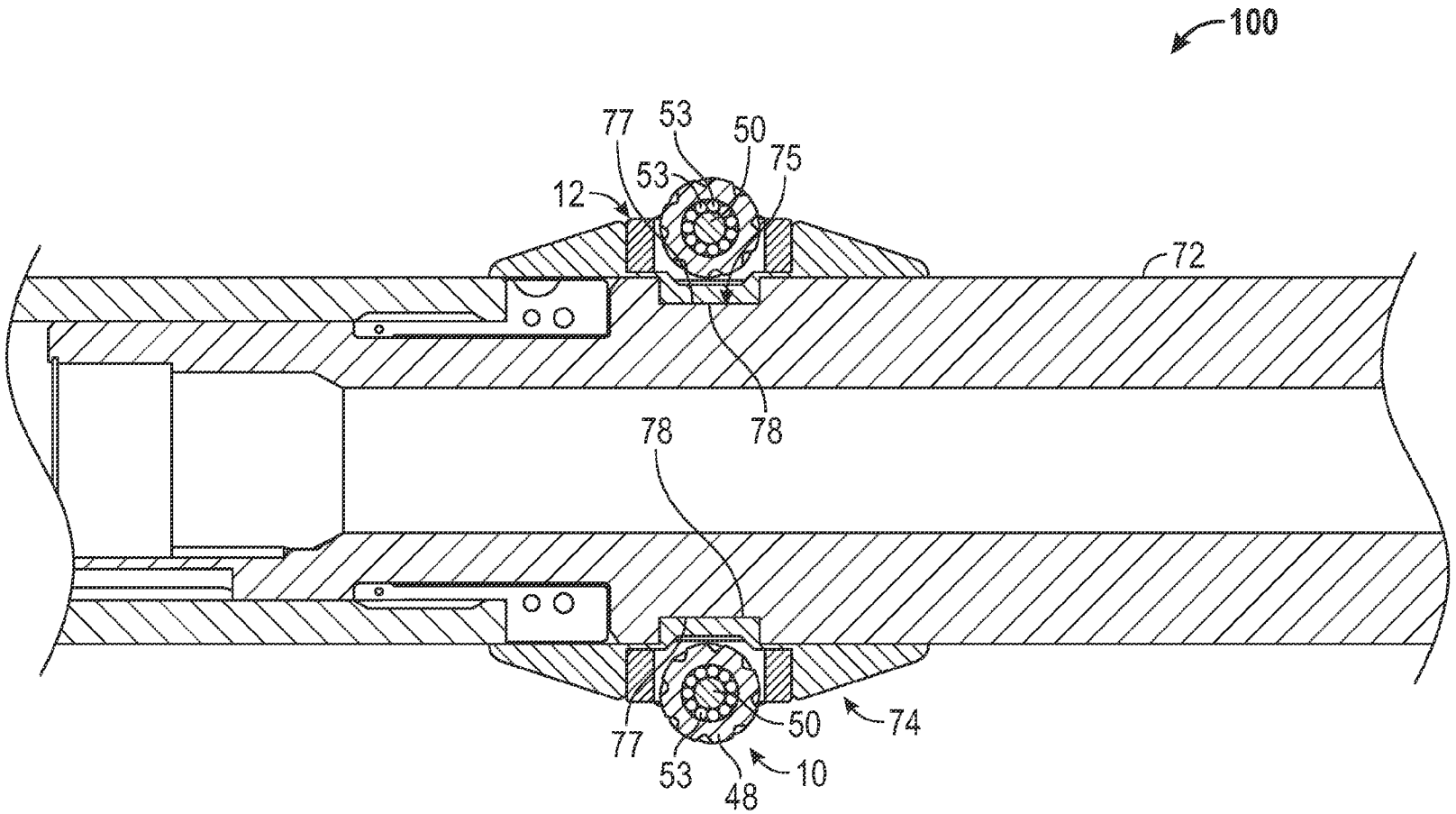
FIG. 13 is a side, cross-sectional view of the roller standoff assembly shown in FIG. 12.

FIGS. 7-11 illustrate an exemplary clamshell adaptor 74 which can be used with the roller standoff devices 10, 10' or 10" to permit the roller standoff devices 10, 10' or 10" to be used with a portion of the inner tubular member or string having flat portions for the engagement of an assembly tool. One example is a hex wrench connection point, which has a collar with six wrench flats for engagement by a wrench. An exemplary hex wrench connection point 75 is shown in FIGS. 9, 12 and 13 with six wrench flats 77 and corners 79. FIGS. 12 and 13 illustrate an exemplary roller standoff assembly 100 which includes a roller standoff device 10 and a clamshell adaptor 74.

The depicted clamshell adaptor 74 is made up of two mating, generally semi-circular adaptor halves 74*a* and 74*b* which can be assembled about the connection collar 75. The adaptor 74 presents a radially interior surface, generally indicated at 76, which is shaped and sized to be complimentary to the surfaces of the wrench flats 77 and corners 79 of the connection collar 75 about which the adaptor 74 is placed. When the clamshell adaptor 74 is disposed upon the connection collar 75, it will be unable to rotate about the collar 75. In the particular embodiment shown in FIGS. 7-13, the adaptor 74 presents six inwardly-facing engagement flats 78 which will matingly contact the wrench flats 77. In particular embodiments, openings 80 are provided between the engagement flats 78 which accommodate the corners 79 of the hex wrench connection collar 75. The inventors have determined that the presence of the openings 80 permits the overall thickness of the adaptor 74 to be minimized.

The exemplary clamshell adaptor 74 also presents an outer radial surface, generally indicated at 82, which is shaped to provide an annular track 84 within which the roller cage 12, 12' of a roller standoff device 10, 10' or 10" can reside and rotate upon. In addition, the outer radial surface 82 of the adaptor 74 includes a pair of shoulders 86, 88 adjacent the track 84 which are shaped and sized to abut each axial side of the roller standoff device 10, 10' or 10" and maintain it upon the track 84. A further advantage of the shoulders 86, 88 is that they prevent the hinge pin 14 and retaining nut 32 from inadvertently backing out and releasing the roller cage 12.

The exemplary roller standoff devices 10, 10' and 10" and roller standoff assemblies 100 of the present invention allow methods to facilitate disposing or conveying a tool or other interior tubular member within an open hole wellbore, a casing, pipe or other outer tubular string or member by reducing frictional engagement between the tool or other interior tubular member and the outer tubular string or member. Frictional engagement is reduced by the rollers 48, 48', which permit ease of translational motion between the interior and exterior tubular members. Frictional engagement is also reduced by axial rotation between the roller standoff device 10, 10' or 10" and the interior tubular member (i.e., 72). Exemplary methods in accordance with the present invention include the step of securing a roller standoff device to an interior tubular member by surrounding the interior tubular member with the roller standoff device and then moving the roller standoff device to a closed configuration so that it radially surrounds the interior tubular member. A latching device is then moved from an unlatched to a latched position to secure the roller standoff device is its closed configuration, the roller standoff device being axially rotatable with respect to the interior tubular member when in the closed configuration. In particular embodiments, the latch assembly is actuated to a latched position by a spring member biasing the latching pin into seating engagement within a latching retainer 38. Thereafter, the interior tubular member and roller standoff device are disposed within an outer tubular member.

Figure 14:
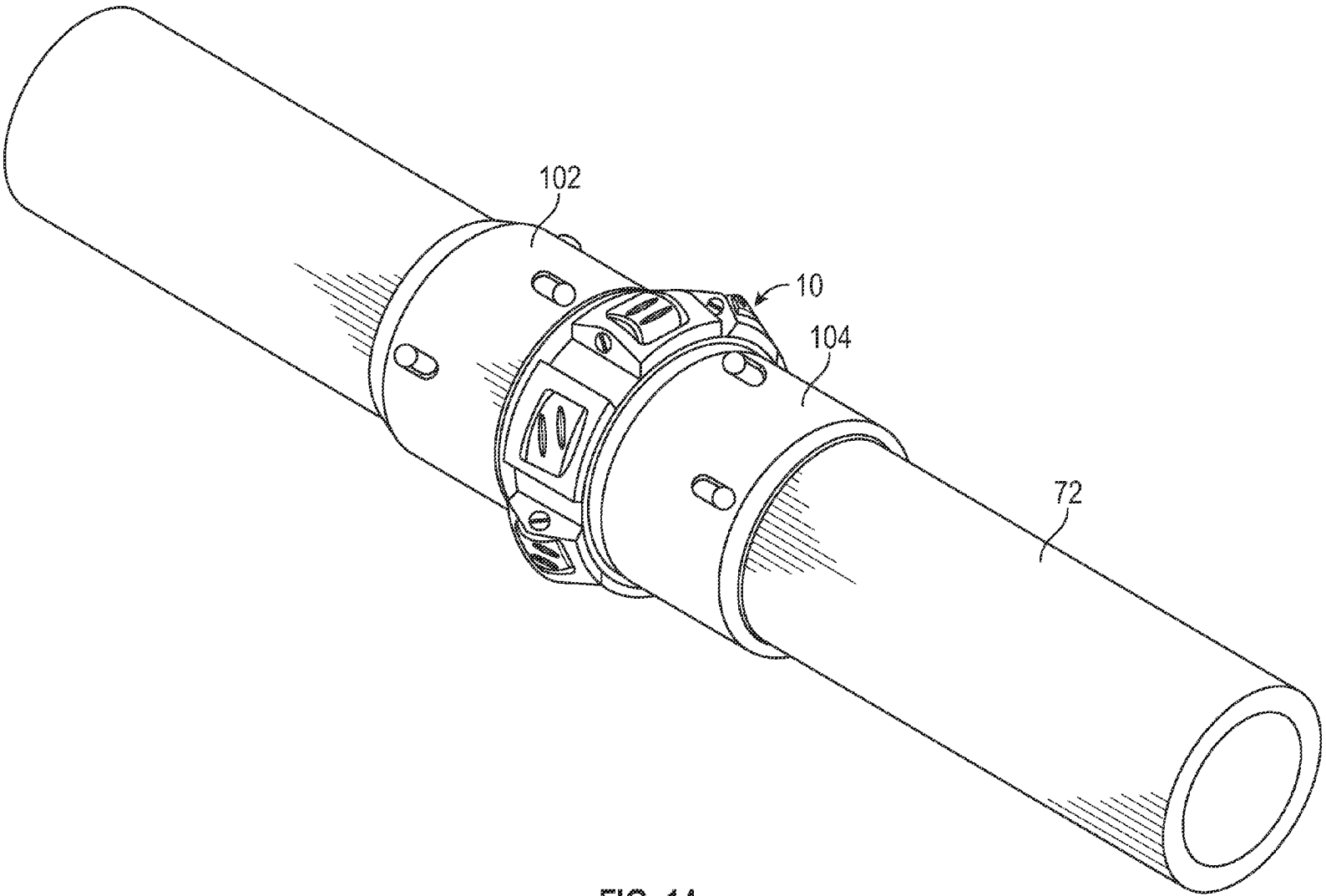
FIG. 14 is an exterior, isometric view of an exemplary roller standoff device which is being retained upon an interior tubular member by a pair of collars.

FIG. 14 depicts a roller standoff device 10 which has been affixed around interior tubular member 72 and which is constrained from axial movement with respect to the interior tubular member 72 by two collars 102, 104. The collars 102, 104 can be secured around the interior tubular member 72 either before or after the roller standoff device 10 has been secured around the tubular member 72, thereby permitting the roller standoff device 10 to be installed at essentially any location upon the interior tubular member 72.

Those of skill in the art will understand that the present invention also provides methods wherein a roller standoff assembly is secured about an interior tubular member and, thereafter, the interior tubular member an roller standoff assembly are disposed into an outer tubular member. A roller standoff assembly is made up of a roller standoff device and a clamshell adaptor. According to exemplary methods, a roller standoff assembly is assembled around an interior tubular member by first disposing a clamshell adaptor around a portion of the interior tubular member and, in particular embodiments, the portion of the interior tubular member is provide with flat portions, such as the wrench flats of a hex wrench connection point. In preferred embodiments, the clamshell adaptor will not rotate axially with respect to the interior tubular member when so assembled. A roller standoff device is then disposed within a track formed on an outer radial surface of the clamshell adaptor so that the roller standoff device is axially rotatable with respect to the interior tubular member.

Within the following claims, the term "interior tubular member" is used to refer generally to a reduced diameter member or string or interconnected members to be disposed within a surrounding tubular member or string. The term "interior tubular member" also includes tools that are to be inserted into a surrounding tubular member or string, including wireline run tools, such as logging tools. The term "exterior tubular member," as used within the claims, refers generally to surrounding tubular members and strings of members, including open hole wellbores, casings, linings, pipes and so forth, into which the interior tubular member is to be disposed.

Those of skill in the art will recognize that numerous modifications and changes may be made to the exemplary designs and embodiments described herein and that the invention is limited only by the claims that follow and any equivalents thereof.

What is claimed is:

1. A roller standoff assembly for facilitating disposing an interior tubular member radially within an exterior tubular member, the roller standoff assembly comprising a roller standoff device comprising:

a roller cage to surround the interior tubular and having two cage halves that are pivotable between an open configuration wherein the roller cage may be placed around the interior tubular member and a closed configuration wherein the roller cage forms a closed annular ring;

a roller supported by the roller cage to contact and roll upon an exterior tubular member; and a latch assembly for securing the roller cage in the closed position, the latch assembly comprising:

a latch retainer;

a latching pin that is moveable between a latched position and an unlatched position to selectively latch within the latch retainer; and a compressible spring biasing the latching pin toward the latched Position;

a clamshell adaptor to permit the roller standoff device to rotate about a portion of the interior tubular member, the interior tublar member having a plurality of wrench flats that are adjoined to each other at corners, the clamshell adaptor comprising:

an annular adaptor body which presents an inner radial surface that is shaped to engage the wrench flats so that the adaptor body does not rotate about the interior tubular member;

an outer radial surface which defines a track upon which the roller standoff device can rotate;

the inner radial surface of the adaptor body includes a plurality of engagement flats to matingly engage the wrench flats; and an opening between adjacent engagement flats, each said opening receiving therein one of said corners.

2. The roller standoff assembly of claim 1 wherein the latch assembly further comprises a groove formed upon the latching pin to be engaged for moving the latching pin between the latched and unlatched positions.

3. The roller standoff assembly of claim 1 wherein:

the roller is generally cylindrical and rotatable about a roller shaft;

the roller presents a radially outer rolling surface to contact and roll against the exterior tubular member; and a plurality of indentations are formed upon the rolling surface and oriented at an acute angle with respect to the roller shaft.

4. The roller standoff assembly of claim 1 wherein the roller comprises a spherical ball.

5. The roller standoff assembly of claim 1 wherein there are a plurality of rollers.

6. The roller standoff assembly of claim 5 wherein there are at least four rollers.

7. The roller standoff assembly of claim 1 wherein the outer radial surface of the adaptor body further includes an annular shoulder adjacent the track to maintain the roller standoff device within the track.

8. A roller standoff assembly for facilitating disposing an interior tubular member radially within an exterior tubular member, the roller standoff assembly comprising a roller standoff device comprising:

a roller cage to surround the interior tubular and form a closed annular ring;

a plurality of rollers supported by the roller cage to contact and roll upon the exterior tubular member, each roller being generally cylindrical and rotatable about a roller shaft;

the roller presenting a radially outer rolling surface to contact and roll against the exterior tubular member;

wherein a plurality of indentations are formed upon the rolling surface and oriented at an acute angle with respect to the roller shaft; and a clamshell adaptor to permit the roller standoff device to rotate about a portion of the interior tubular member, the interior tublar member having a plurality of wrench flats that are adjoined to each other at corners, the clamshell adaptor comprising:

an annular adaptor body which presents an inner radial surface that is shaped to engage the wrench flats so that the adaptor body does not rotate about the interior tubular member;

an outer radial surface which defines a track upon which the roller standoff device can rotate;

the inner radial surface of the adaptor body includes a plurality of engagement flats to matingly engage the wrench flats; and the inner radial surface of the adaptor body further includes an opening between adjacent engagement flats, each said opening receiving therein one of said corners.

9. The roller standoff assembly of claim 8 wherein the roller cage comprises:

two cage halves that are pivotable between an open configuration wherein the roller cage may be placed around the interior tubular member and a closed configuration wherein the roller cage forms a closed annular ring;

a latch assembly for securing the roller cage in the closed position, the latch assembly comprising:

a latch retainer;

a latching pin that is moveable between a latched position and an unlatched position to selectively latch within the latch retainer; and a compressible spring biasing the latching pin toward the latched position.

10. The roller standoff assembly of claim 9 wherein the latch assembly further comprises a groove formed upon the latching pin to be engaged for moving the latching pin between the latched and unlatched positions.

11. The roller standoff assembly of claim 8 wherein the outer radial surface of the adaptor body further includes an annular shoulder adjacent the track to maintain the roller standoff device within the track.

12. A roller standoff assembly for facilitating disposing an interior tubular member radially within an exterior tubular member, the roller standoff assembly comprising:

a roller standoff device comprising:

a roller cage to surround the interior tubular and having two cage halves that are pivotable between an open configuration wherein the roller cage may be placed around the interior tubular member and a closed configuration wherein the roller cage forms a closed annular ring;

a roller supported by the roller cage to contact and roll upon an exterior tubular member;

a latch assembly for securing the roller cage in the closed position, the latch assembly comprising:

a latch retainer;

a latching pin that is moveable between a latched position and an unlatched position to selectively latch within the latch retainer;

a compressible spring biasing the latching pin toward a latched position; and a clamshell adaptor disposed between the interior tubular member and the exterior tubular member, the clamshell adaptor having:

an adaptor body which presents an inner radial surface to engage wrench flats on the interior tubular member that are adjoined to each other at corners so that the adaptor body does not rotate about the interior tubular member;

an outer radial surface which defines a track upon which the roller standoff device can rotate;

the inner radial surface includes a plurality of engagement flats to matingly engage the wrench flats; and the inner radial surface of the adaptor body further includes an opening between adjacent engagement flats, each said opening receiving therein one of said corners.

13. The roller standoff assembly of claim 12 wherein the roller comprises a spherical ball.

14. The roller standoff assembly of claim 12 wherein:

the roller is generally cylindrical and rotatable about a roller shaft;

the roller presents a radially outer rolling surface to contact and roll against the exterior tubular member; and a plurality of indentations are formed upon the rolling surface and oriented at an acute angle with respect to the roller shaft.

15. The roller standoff assembly of claim 12 wherein the clamshell adaptor further comprises two mating adaptor halves.

16. A method to facilitate disposing an interior tubular member into an exterior tubular member, the interior tubular member presenting a plurality of wrench flats that are adjoined to each other at corners, the method comprising the steps of:

securing a clamshell adaptor around the interior tubular member, the clamshell adaptor having an adaptor body with a plurality of engagement flats to matingly engage the wrench flats and an opening between adjacent engagement flats to receive therein one of said corners;

securing a roller standoff device having a roller cage and at least one roller supported by the roller cage around the interior tubular member by surrounding the interior tubular member and clamshell adaptor with the roller cage and then moving the roller cage to a closed configuration so that is radially surrounds the interior tubular member;

actuating a latch assembly to secure the roller standoff device in the closed configuration, the latch assembly being actuated by biasing a latching pin into seating engagement within a latching retainer, the roller standoff device being rotatable axially with respect to the interior tubular member when in the closed configuration; and disposing the interior tubular member and roller standoff device into the exterior tubular member so that the at least one roller rolls upon the exterior tubular member.

17. The method of claim 16 wherein the step of disposing the interior tubular member and roller standoff device into the exterior tubular member further comprises rolling at least two rollers upon a lower portion of the exterior tubular member to provide a standoff clearance between the interior tubular member and the exterior tubular member.

18. The method of claim 16 further comprising the step of:

disposing the roller standoff device within a track formed upon an outer radial surface of the clamshell adaptor.

19. The method of claim 16 further comprising the step of:

disposing the roller standoff device axially between two shoulders on the interior tubular member to inhibit axial movement of the roller standoff device with respect to the interior tubular member.

* * * * *

UNITED STATES PATENT AND TRADEMARK OFFICE

CERTIFICATE OF CORRECTION

PATENT NO. : 8,733,455 B2
APPLICATION NO. : 13/436950
DATED : May 27, 2014
INVENTOR(S) : Shaikh et al.

It is certified that error appears in the above-identified patent and that said Letters Patent is hereby corrected as shown below:

In the Claims

Claim 1, Column 7, line 10, the word 'Position' should read -position-.

Signed and Sealed this
Fifteenth Day of July, 2014

Michelle K. Lee

Michelle K. Lee
*Deputy Director of the United States Patent and Trademark Office*